US011805588B1

(12) United States Patent
Mizerak et al.

(10) Patent No.: US 11,805,588 B1
(45) Date of Patent: Oct. 31, 2023

(54) COLLISION DETECTION FOR VENUE LIGHTING

(71) Applicant: Electronic Theatre Controls, Inc., Middleton, WI (US)

(72) Inventors: Christopher Mizerak, Oceanside, CA (US); Ethan White, Verona, WI (US); Matthew Halberstadt, Middleton, WI (US); Dan Duffy, Middleton, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 17/877,223

(22) Filed: Jul. 29, 2022

(51) Int. Cl.
*H05B 47/105* (2020.01)
*H05B 47/165* (2020.01)
*H05B 47/155* (2020.01)

(52) U.S. Cl.
CPC ..... *H05B 47/105* (2020.01); *H05B 47/155* (2020.01); *H05B 47/165* (2020.01)

(58) Field of Classification Search
CPC ... H05B 47/105; H05B 47/155; H05B 47/165
See application file for complete search history.

(56) References Cited

U.S. PATENT DOCUMENTS 6,079,862 A * 6/2000 Kawashima ..... G01S 3/7864 700/59
8,917,905 B1 * 12/2014 Dill ..... H05B 47/10 382/103
10,140,754 B1 11/2018 Voris et al.
2002/0122042 A1 9/2002 Bates et al.
2005/0248299 A1 * 11/2005 Chemel ..... H05B 47/155 315/312
2008/0186720 A1 * 8/2008 Verbrugh ..... G01D 5/30 362/383
2009/0215533 A1 8/2009 Zalewski et al.
2009/0237564 A1 9/2009 Kikinis et al.
2010/0200573 A1 * 8/2010 Hallac ..... H05B 6/701 219/693
2011/0137753 A1 6/2011 Moehrle
2014/0192087 A1 7/2014 Frost
2015/0016712 A1 1/2015 Rhoads et al.
2015/0023602 A1 1/2015 Wnuk et al.
(Continued)

OTHER PUBLICATIONS

United States Patent Office Action for U.S. Appl. No. 16/708,781 dated Mar. 25, 2022 (15 pages).

*Primary Examiner* — Raymond R Chai
(74) *Attorney, Agent, or Firm* — Michael Best & Friedrich LLP

(57) ABSTRACT

Systems and methods for producing a lighting design for an event at a venue. One system includes a lighting fixture configured to project a light beam, an input device configured to receive a user input, and a controller including an electronic processor and a memory. The controller is configured to determine a path of the light beam, receive a first user input indicating a target of interest, and receive a second user input assigning a characteristic to the target of interest. The controller is configured to detect a collision between the path of the light beam and the target of interest, determine, in response to the collision, whether to project light onto the target of interest based on the characteristic, and control the lighting fixture to project the light beam on the target of interest.

20 Claims, 16 Drawing Sheets

(56) References Cited

U.S. PATENT DOCUMENTS

| | | | | |
|---|---|---|---|---|
| 2015/0294492 | A1 | 10/2015 | Koch et al. | |
| 2016/0012640 | A1 | 1/2016 | Abraham | |
| 2016/0171127 | A1 | 6/2016 | Gannon et al. | |
| 2018/0047207 | A1 | 2/2018 | Eskander et al. | |
| 2018/0174347 | A1 | 6/2018 | Chaney | |
| 2018/0295419 | A1 | 10/2018 | Thielen et al. | |
| 2020/0187334 | A1 | 6/2020 | Crawford et al. | |
| 2021/0392462 | A1* | 12/2021 | Feeney | F21V 14/04 |
| 2022/0030149 | A1* | 1/2022 | Moore | H04N 23/667 |

* cited by examiner

COLLISION DETECTION FOR VENUE LIGHTING

FIELD

Embodiments described herein relate to producing a lighting design for an event at a venue.

SUMMARY

Designing, updating, testing, and calibrating lighting visuals are important parts of preparing the lighting fixtures at a venue for an upcoming event. The lighting visuals can be of varying composition types including, but not limited to, static or dynamic combinations of lighting elements. Lighting visuals include, for example, moving lighting transitions, follow spots, and other dynamic lighting visuals (e.g., fading and other transitions). Lighting visuals can also include static background lighting (e.g., color, intensity, saturation, etc.).

Some of the most important information about an upcoming show is where the performers, moving scenery elements, or other objects will be on the stage throughout the show. This information tells a user where to direct the lighting visuals throughout the show. Other important information, such as the body language of a performer and the duration of time a performer remains at a certain mark on the stage, can also be helpful in determining the brightness, color, mood, shape, focus, and other features of the lighting visuals to be used.

Ideally, the user would be able to have the performers conduct as many rehearsals as necessary for lighting design purposes. Rehearsals are limited, however, because of the time constraints, costs, and need for live performers. Often, only a few rehearsals are performed at a venue prior to an event. Perhaps only one of those rehearsals, if any, is a full dress rehearsal. This limited insight into the dynamics and appearance of the performers and moving objects can inhibit the creation and improvement of desired lighting visuals. Further, last-minute changes to the lighting visuals typically have to be improvised at the event if a last-minute rehearsal is not possible.

Additionally, many events require hundreds of lighting fixtures and dozens of distinct lighting visuals. The time required to get the lighting fixtures ready for each particular lighting visual makes it difficult to time the preparation of the lighting visuals such that they can be tested during a dress rehearsal. In some of the most difficult situations, a user may only receive movement information in the form of one or more marks made with tape on the surface of a stage to indicate performer locations. Given the minimal rehearsals, lighting designers may lean away from complex light effects, such as keeping particular areas dark, changing lighting effects for particular objects, maintaining lighting effects on a particular object as they move, or the like. Such features are difficult to set on short notice and are difficult to improvise.

To address these concerns, embodiments described herein provide systems and methods for calibrating and configuring venue lighting features in a virtual environment. The virtual environment provides for assigning metadata to particular objects and areas of interest within the venue. As light collides with the objects and areas of interest, the operation of the lighting fixture projecting the light within the virtual environment is adjusted to perform a function indicated by the metadata. Each lighting fixture is associated with a physical lighting fixture within a venue. Commands for the physical lighting fixtures are generated based on the performance of lighting fixtures within the virtual environment.

One embodiment provides a system for controlling lighting in a venue. The system includes a lighting fixture configured to project a light beam, an input device configured to receive a user input, and a controller including an electronic processor and a memory. The controller is configured to determine, when the lighting fixture is deactivated, a path of the light beam, receive a first user input indicating a target of interest, and receive a second user input assigning a characteristic to the target of interest, the characteristic indicating whether to project the light beam on the target of interest. The controller is configured to detect a collision between the path of the light beam and the target of interest, determine, in response to the collision, whether to project light onto the target of interest based on the characteristic, and control, in response to the characteristic indicating to project light onto the target of interest, the lighting fixture to project the light beam on the target of interest.

Another embodiment provides a system for controlling lighting in a venue. The system includes a lighting fixture configured to project a light beam, an input device configured to receive a user input, and a controller including an electronic processor and a memory. The controller is configured to determine a path of the light beam, receive a first user input indicating a target of interest, and receive a second user input assigning a characteristic to the target of interest. The controller is configured to monitor, over a first time period, for one or more collisions between the path of the light beam and the target of interest, generate a plurality of command frames based on the one or more collisions and based on the characteristic assigned to the target of interest, and control, with the plurality of command frames, the lighting fixture.

Another embodiment provides a system for controlling lighting in a venue. The system includes a lighting fixture configured to project a light beam, an input device configured to receive a user input, and a controller including an electronic processor and a memory. The electronic processor is configured to interact with a virtual environment stored in the memory. The electronic processor is configured to determine a path of a virtual light beam projected by a virtual lighting fixture, receive a first user input indicating a target of interest within the virtual environment, and receive a second user input assigning a characteristic to the target of interest, the characteristic indicating whether to project the virtual light beam on the target of interest. The electronic processor is configured to monitor, over a first time period, for one or more collisions between the path of the virtual light beam and the target of interest, generate a plurality of command frames based on the one or more collisions and based on the characteristic assigned to the target of interest, and control, with the plurality of command frames, the lighting fixture.

Before any embodiments are explained in detail, it is to be understood that the embodiments are not limited in its application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components, may be utilized to implement the embodiments. For example, "servers" and "computing devices" described in the specification can include one or more processing units, one or more computer-readable medium modules, one or more input/output interfaces, and various connections (e.g., a system bus) connecting the components.

Other aspects of the embodiments will become apparent by consideration of the detailed description and accompanying drawings.

DETAILED DESCRIPTION

Providing lighting designers, lighting console operators, lighting system technicians, or the like with adequate information as to where the performers, moving scenery elements, or other objects will be on the stage throughout a show, the body language of the performers, and other aesthetic features of the performers typically requires at least one dress rehearsal. Completing the lighting design for the lighting visuals in time to test them during a rehearsal is very difficult, and any changes between rehearsals or after the final rehearsal are prone to mistakes and inaccuracies. Systems and methods described herein provide a virtual environment for calibrating lighting events based on positions of objects and areas of interest on stage prior to the actual performance. These systems and methods address the technical problems associated with designing, calibrating, and updating lighting visuals in a lighting design. The lighting visuals can be of varying composition types including, but not limited to, static or dynamic combinations of lighting elements. Lighting visuals include, for example, moving lighting transitions, follow spots, and other dynamic lighting visuals (e.g., fading and other transitions). Lighting visuals can also include static background lighting (e.g., color, intensity, saturation, fading, etc.).

Figure 1:
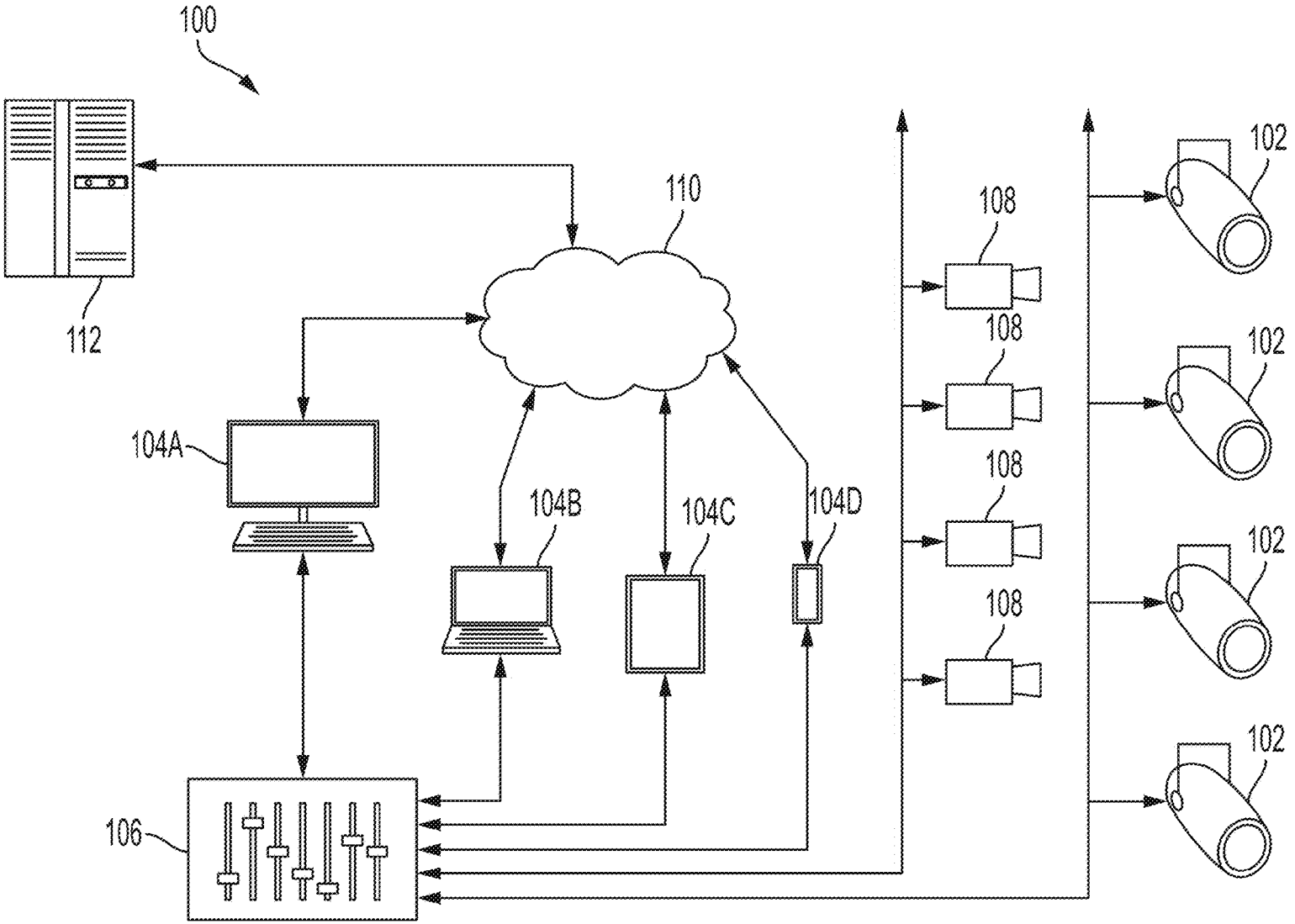
FIG. 1 illustrates a system for generating a lighting design for a venue, according to one example.

FIG. 1 illustrates a system 100 for generating a lighting design for an event or venue and subsequently controlling one or more lighting fixtures 102. The system 100 includes a user input device 104A-104D, a control board or control panel 106, lighting fixtures 102, cameras 108, a network 110, and a server-side computer or server 112. The lighting fixtures 102 may be set "ON" (e.g., activated) to project light (e.g., project a light beam), and may alternatively be set "OFF" (e.g., deactivated) to not project light. The user input device 104A-104D includes, for example, a personal or desktop computer 104A, a laptop computer 104B, a tablet computer 104C, or a mobile phone (e.g., a smart phone) 104D. Other user input devices 104A-104D may include, for example, an augmented reality headset or glasses. In some embodiments, the cameras 108 are integrated with the user input device 104A-104D, such as the camera of the mobile phone 104D. In other embodiments, the cameras 108 are entirely separate from the user input device 104A-104D. Example cameras 108 include, for instance, stereo cameras for gathering data including depth, infrared cameras for gathering data in low-light conditions, scanners detecting a laser in a Light Detection and Ranging ("LIDAR") operation, motion capture tools (such as those produced by Vicon Motion Systems), projected structured light cameras, or the like.

The user input device 104A-104D is configured to communicatively connect to the server 112 through the network 110 and provide information to, or receive information from, the server 112 related to the control or operation of the system 100. The user input device 104A-104D is also configured to communicatively connect to the control board 106 to provide information to, or receive information from, the control board 106. The connections between the user input device 104A-104D and the control board 106 or network 110 are, for example, wired connections, wireless connections, or a combination of wireless and wired connections. Similarly, the connections between the server 112 and the network 110, the control board 106 and the lighting fixtures 102, or the control board 106 and the cameras 108 are wired connections, wireless connections, or a combination of wireless and wired connections.

The network 110 is, for example, a wide area network ("WAN") (e.g., a TCP/IP based network), a local area network ("LAN"), a neighborhood area network ("NAN"), a home area network ("HAN"), or personal area network ("PAN") employing any of a variety of communications protocols, such as Wi-Fi, Bluetooth, ZigBee, etc. In some implementations, the network 110 is a cellular network, such as, for example, a Global System for Mobile Communications ("GSM") network, a General Packet Radio Service ("GPRS") network, a Code Division Multiple Access ("CDMA") network, an Evolution-Data Optimized ("EV-DO") network, an Enhanced Data Rates for GSM Evolution ("EDGE") network, a 3GSM network, a 4GSM network, a 4G Long-Term Evolution ("LTE") network, a 5G New Radio, a Digital Enhanced Cordless Telecommunications ("DECT") network, a Digital AMPS ("IS-136/TDMA") network, or an Integrated Digital Enhanced Network ("iDEN") network, etc.

Figure 1A:
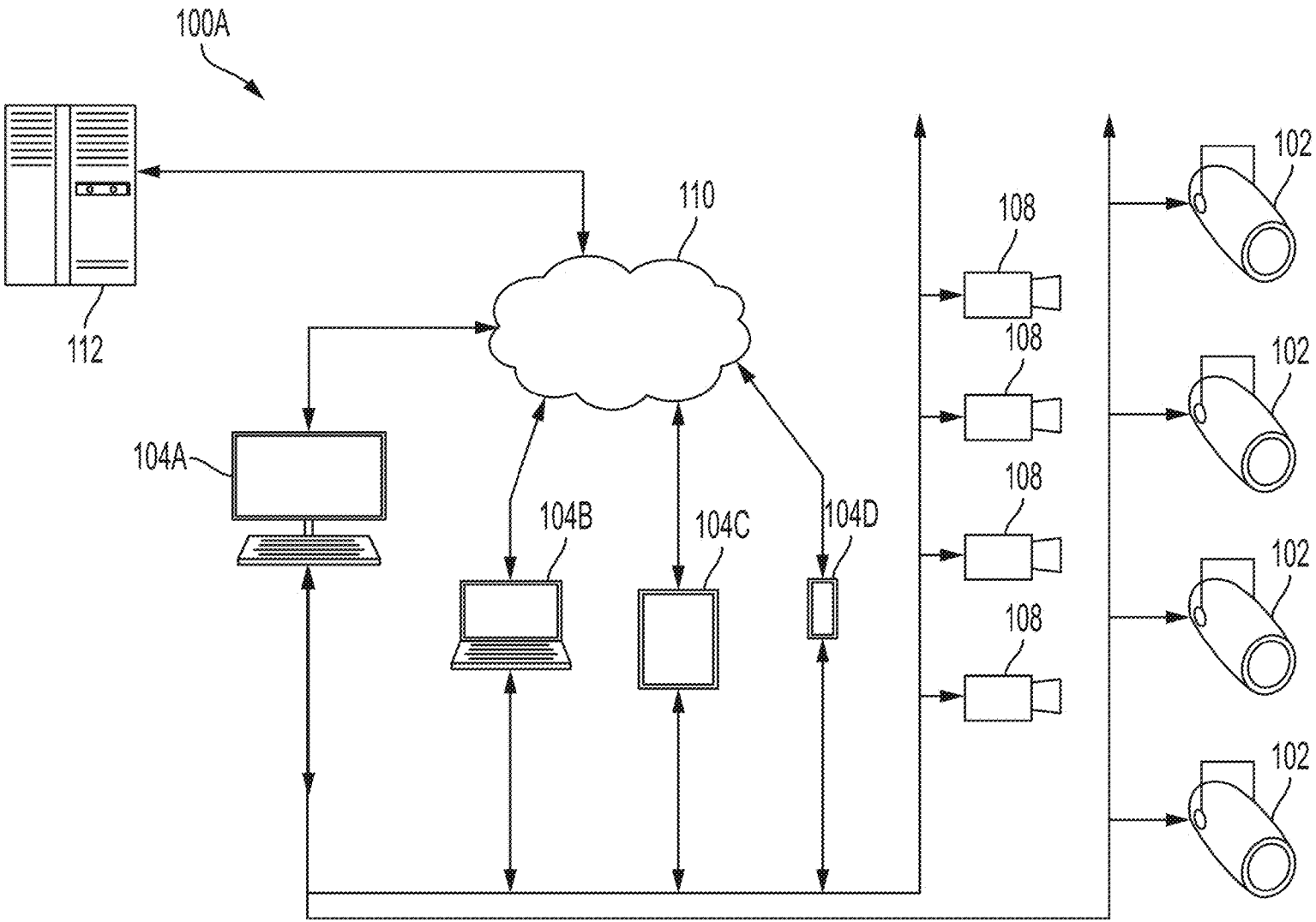
FIG. 1A illustrates an alternative system for generating a lighting design for a venue, according to one example.

FIG. 1A illustrates an alternative system 100A for generating a lighting design for an event or venue and subsequently controlling a lighting fixture 102. The hardware of the alternative system 100A is identical to the above system 100, except the control board or control panel 106 is removed. As such, the user input device 104A-104D is configured to communicatively connect to the lighting fixture 102 and to the cameras 108. The connections between the user input device 104A-104D and the lighting fixture 102, and the connections between the user input device 104A-104D and the cameras 108, are wired connections, wireless connections, or a combination of wireless and wired connections.

Figure 2:
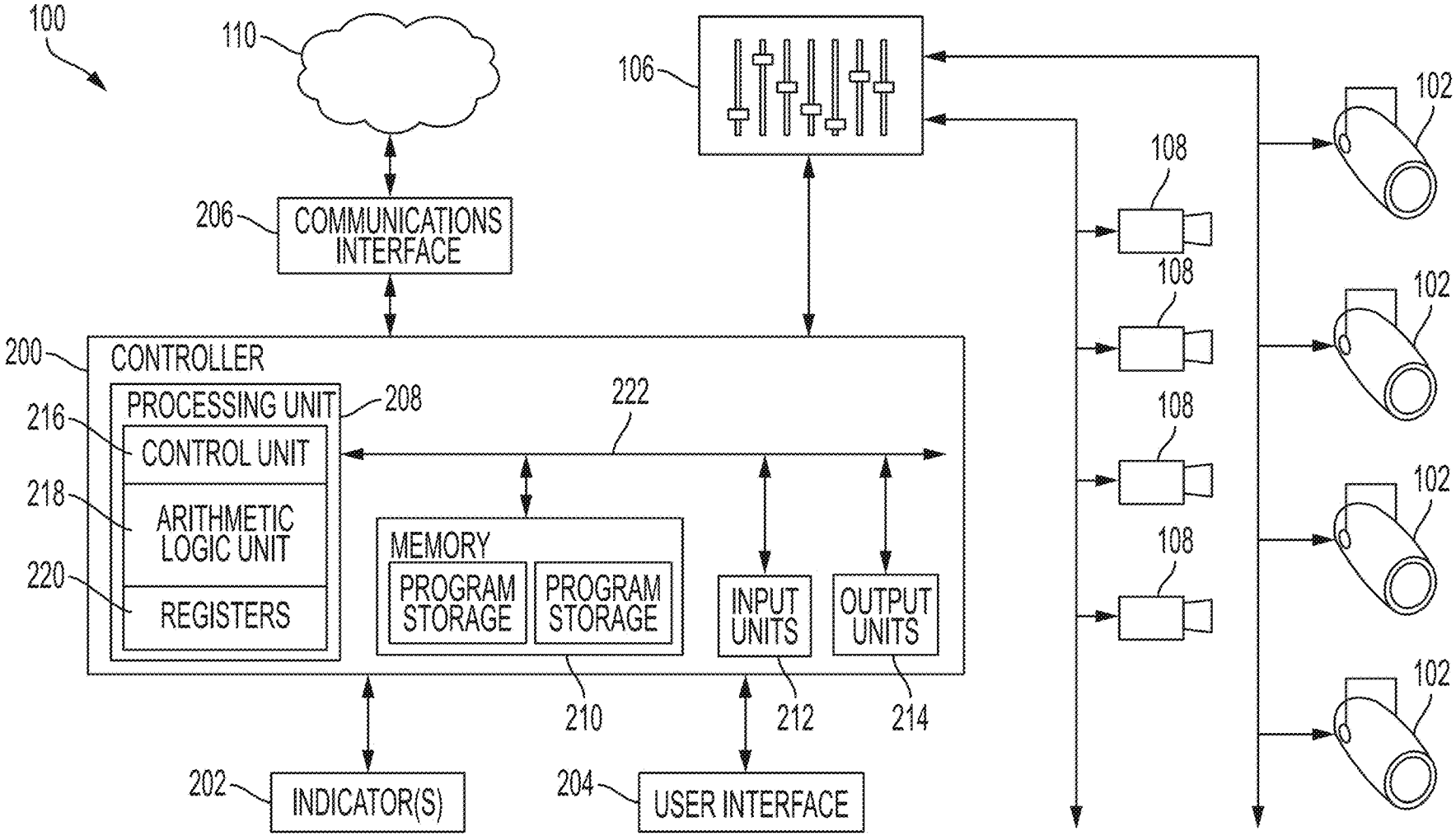
FIG. 2 illustrates a controller for the system of FIG. 1, according to one example.

FIG. 2 illustrates a controller 200 for the system 100. The controller 200 is electrically and/or communicatively connected to a variety of modules or components of the system 100. For example, the illustrated controller 200 is connected to one or more indicators 202 (e.g., LEDs, a liquid crystal display ["LCD"], etc.), a user input or user interface 204 (e.g., a user interface of the user input device 104A-104D in FIG. 1), and a communications interface 206. The controller 200 is also connected to the control board 106. The communications interface 206 is connected to the network 110 to enable the controller 200 to communicate with the server 112. The controller 200 includes combinations of hardware and software that are operable to, among other things, control the operation of the system 100, control the operation of the lighting fixture 102, control the operation of the cameras 108, receive one or more signals from the camera 108s, communicate over the network 110, communicate with the control board 106, receive input from a user via the user interface 204, provide information to a user via the indicators 202, etc. In some embodiments, the indicators 202 and the user interface 204 may be integrated together in the form of, for instance, a touch-screen.

In the embodiment illustrated in FIG. 2, the controller 200 is associated with the user input device 104A-104D. As a result, the controller 200 is illustrated in FIG. 2 as being connected to the control board 106 which is, in turn, connected to the lighting fixtures 102 and the cameras 108. In other embodiments, the controller 200 is included within the control board 106, and, for example, the controller 200 can provide control signals directly to the lighting fixtures 102 and the cameras 108. In other embodiments, the controller 200 is associated with the server 112 and communicates through the network 110 to provide control signals to the control board 106, the lighting fixtures 102, and the cameras 108.

The controller 200 includes a plurality of electrical and electronic components that provide power, operational control, and protection to the components and modules within the controller 200 and/or the system 100. For example, the controller 200 includes, among other things, a processing unit 208 (e.g., an electronic processor, a microprocessor, a microcontroller, or another suitable programmable device), a memory 210, input units 212, and output units 214. The processing unit 208 includes, among other things, a control unit 216, an arithmetic logic unit ("ALU") 218, and a plurality of registers 220 (shown as a group of registers in FIG. 2), and is implemented using a known computer architecture (e.g., a modified Harvard architecture, a von Neumann architecture, etc.). The processing unit 208, the memory 210, the input units 212, and the output units 214, as well as the various modules or circuits connected to the controller 200 are connected by one or more control and/or data buses (e.g., common bus 222). The control and/or data buses are shown generally in FIG. 2 for illustrative purposes. The use of one or more control and/or data buses for the interconnection between and communication among the various modules, circuits, and components would be known to a person skilled in the art in view of the embodiments described herein.

The memory 210 is a non-transitory computer readable medium and includes, for example, a program storage area and a data storage area. The program storage area and the data storage area can include combinations of different types of memory, such as a ROM, a RAM (e.g., DRAM, SDRAM, etc.), EEPROM, flash memory, a hard disk, an SD card, or other suitable magnetic, optical, physical, or electronic memory devices. The processing unit 208 is connected to the memory 210 and executes software instructions that are capable of being stored in a RAM of the memory 210 (e.g., during execution), a ROM of the memory 210 (e.g., on a generally permanent basis), or another non-transitory computer readable medium such as another memory or a disc. Software included in the implementation of the system 100 and controller 200 can be stored in the memory 210 of the controller 200. The software includes, for example, firmware, one or more applications, program data, filters, rules, one or more program modules, and other executable instructions. The controller 200 is configured to retrieve from the memory 210 and execute, among other things, instructions related to the control processes and methods described herein. In other embodiments, the controller 200 includes additional, fewer, or different components.

The user interface 204 is included to provide user control of the system 100, the lighting fixture 102, and/or the camera 108. The user interface 204 is operably coupled to the controller 200 to control, for example, drive signals provided to the lighting fixture 102 and/or drive signals provided to the cameras 108. The user interface 204 can include any combination of digital and analog input devices required to achieve a desired level of control for the system 100. For example, the user interface 204 can include a computer having a display and input devices, a touch-screen display, a plurality of knobs, dials, switches, buttons, faders, or the like. In the embodiment illustrated in FIG. 2, the user interface 204 is separate from the control board 106. In other embodiments, the user interface 204 is included in the control board 106.

The controller 200 is configured to work in combination with the control board 106 to provide direct control or drive signals to the lighting fixtures 102 and/or the cameras 108. As described above, in some embodiments, the controller 200 is configured to provide direct drive signals to the lighting fixtures 102 and/or the cameras 108 without separately interacting with the control board 106 (e.g., the control board 106 includes the controller 200). The direct drive signals that are provided to the lighting fixtures 102 and/or the cameras 108 are provided, for example, based on a user input received by the controller 200 from the user interface 204. The controller 200 is also configured to receive one or more signals from the cameras 108 related to image or scan data.

Figure 2A:
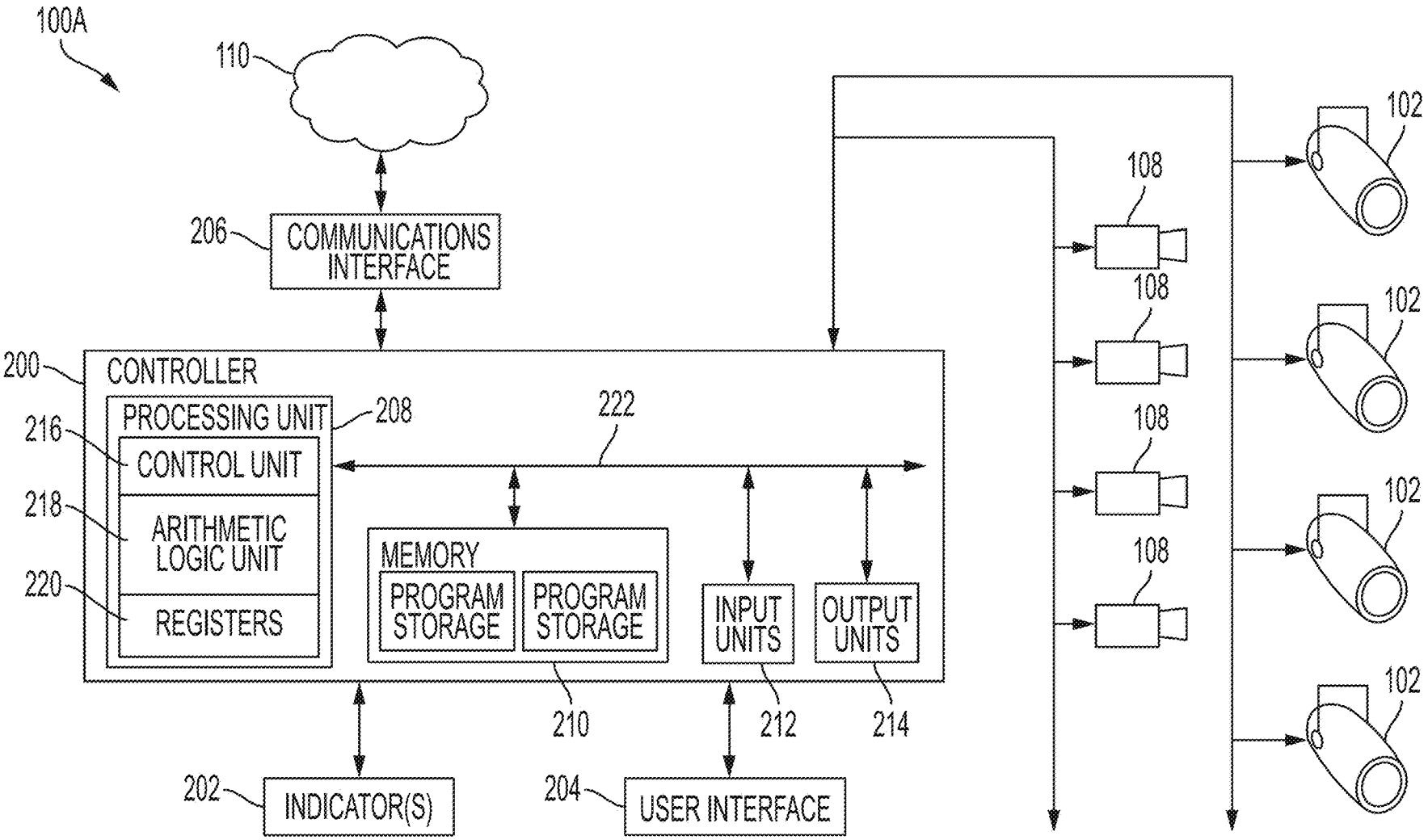
FIG. 2A illustrates a controller for the system of FIG. 1A, according to one example.

As shown in FIG. 2A and described above, the system 100A includes the controller 200 configured to work without the control board 106, such that the controller 200 is configured to provide signals to the lighting fixtures 102 and/or the cameras 108 and to receive one or more signals from the cameras 108 related to image or scan data.

Figure 3:
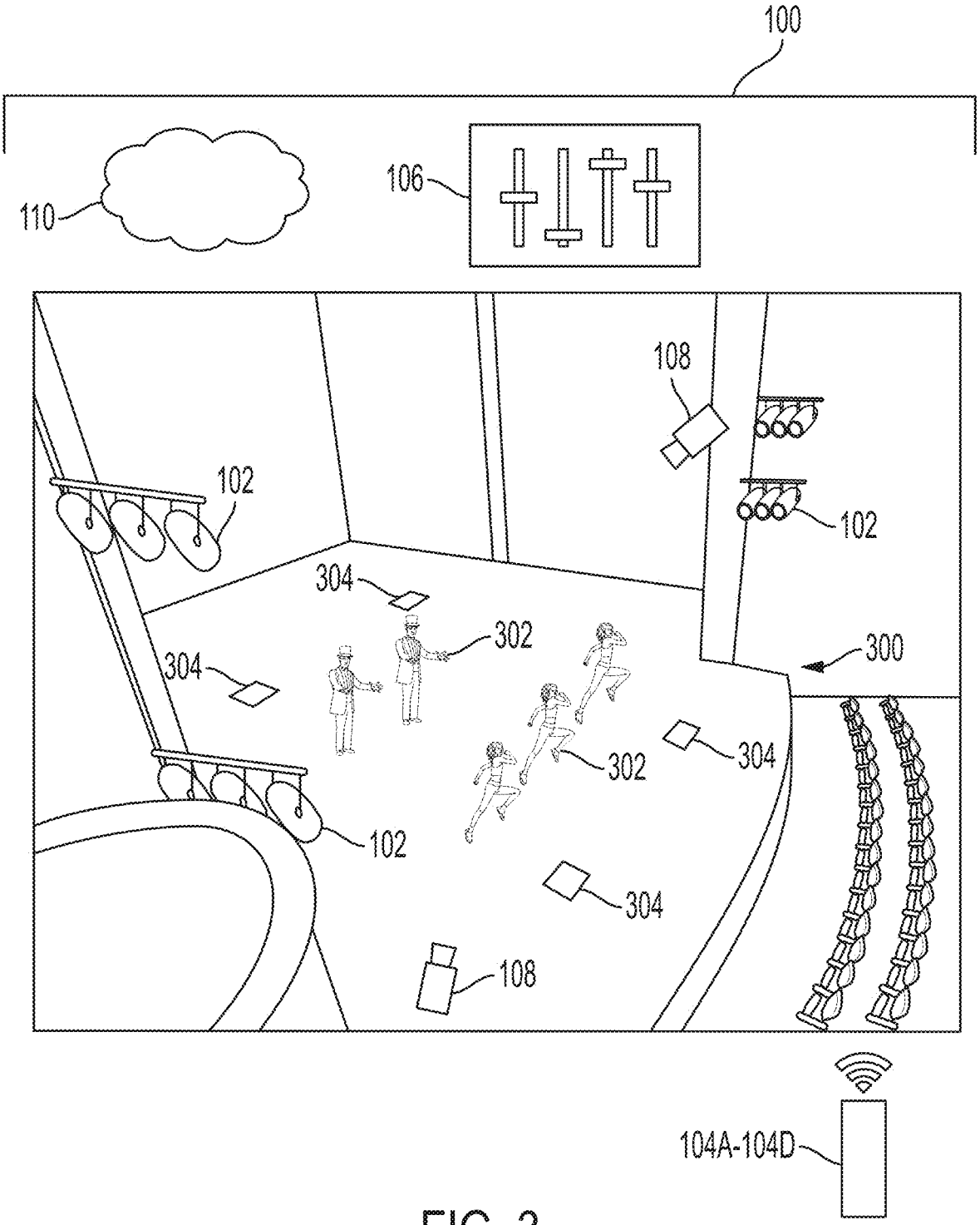
FIG. 3 illustrates a control board, a camera, and a lighting fixture in a venue during a rehearsal for the system of FIG. 1, according to one example.

FIG. 3 illustrates the lighting fixtures 102, the user input device 104A-104D, the control board 106, and the cameras 108 in a venue 300. The cameras 108 capture the physical characteristics and/or movement of an object 302 as object data, such as a scenery component or a performer, during a rehearsal, a show, a demonstration, or the like (e.g., the cameras 108 are mounted at known locations in the venue 300 and record video of the moving objects). Additional sensors or markers can be used to track position and orientation of the objects 302 to augment the data that is recorded with the cameras 108 to improve accuracy. These sensors or markers may include, for instance, one or more proximity sensors, radio-frequency identification ("RFID") tags and sensors, ultra-wide band ("UWB") sensors, one or more LIDAR sensors, or the like. Further, one or more reference points 304 may be indicated with a marker to be detected by the cameras 108. The reference points 304 can establish relative locations of the objects 302 regarding their surroundings and can be helpful in calibration of the lighting fixtures 102. The controller 200 receives scan data from the cameras 108 to gather input about the physical characteristics and/or movement of the objects 302.

In some instances, a virtual environment (e.g., a three-dimensional representation) of the venue 300 is provided within the server 112. The virtual environment may include set pieces, props, and actors to represent a production performed within the venue 300. In some instances, the virtual production is downloaded or otherwise pre-loaded into the virtual environment. In other instances, an operator of the user input device 104A-104D interfaces with the server 112 using the network 110 to manually configure the virtual production within the virtual environment. In yet another instance, the set pieces, props, and actors may be captured by the cameras 108 and "scanned" into the virtual environment using an image capturing algorithm. Accordingly, the virtual production is representative of the location of set pieces, props, and actors within the physical production performed at the venue 300.

In some implementations, the virtual environment further includes a virtual representation of the one or more lighting fixtures 102. A user may set characteristics of the set pieces, props, and actors within the virtual production to alter how light beams from the virtual lighting fixtures interact with and project light onto the set pieces, props, and actors. As the virtual environment is altered, commands for controlling the one or more lighting fixtures 102 during the actual, physical production may be generated. Users may alter and interact with elements within the virtual environment using the user interface 204 or the user input devices 104A-104D. Accordingly, systems and methods described herein allow for pre-setting complex lighting features that may then be adjusted during rehearsals within the venue 300.

Figure 4:
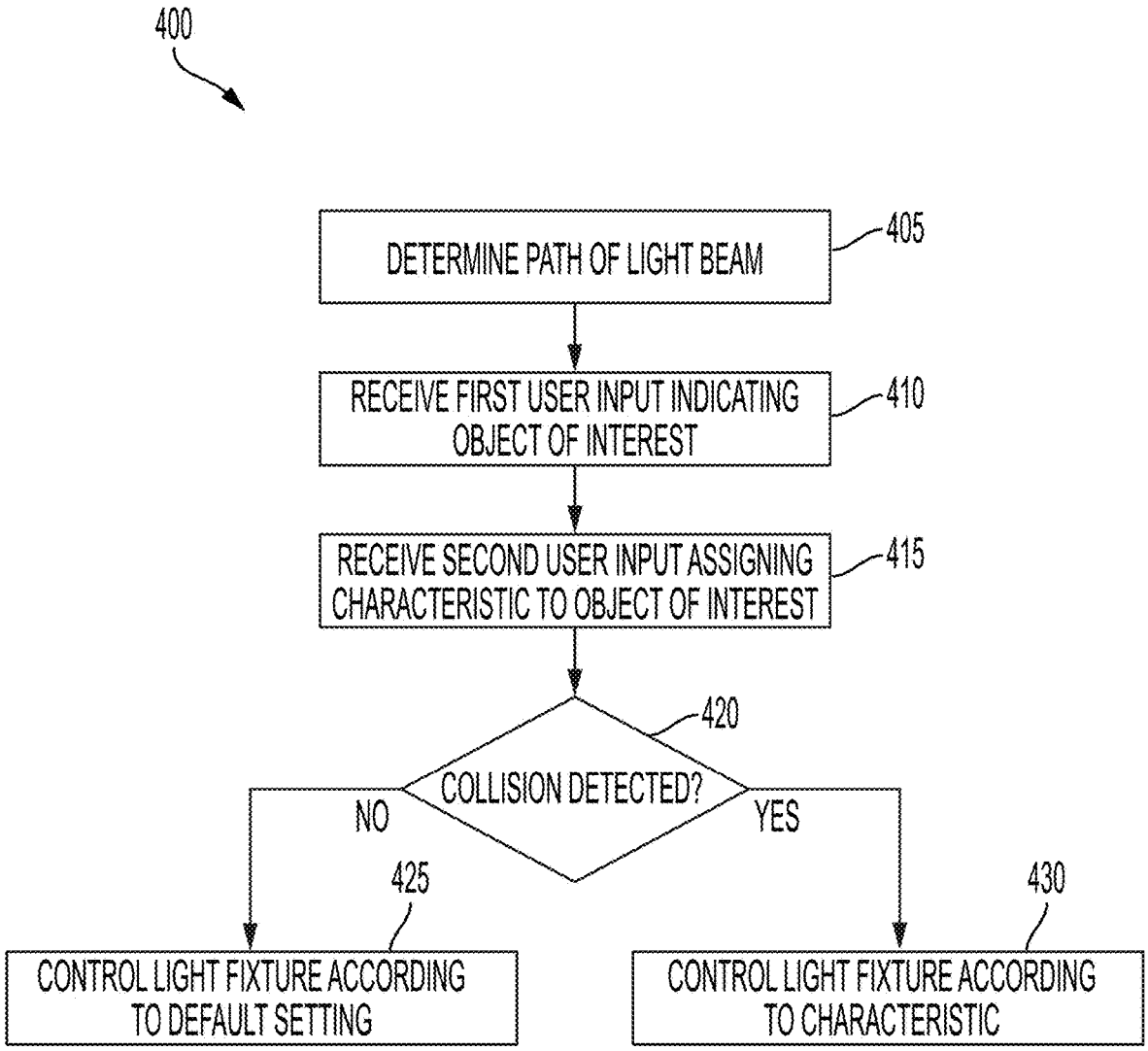
FIG. 4 illustrates a method performed by the controller of FIG. 2 or FIG. 2A, according to one example.

FIG. 4 provides a method 400 for producing a lighting design for the venue 300. The steps of the method 400 are described in an iterative manner for descriptive purposes. Various steps described herein with respect to the method 400 are capable of being executed simultaneously, in parallel, or in an order that differs from the illustrated serial and iterative manner of execution. Additionally, while the method 400 is described as being performed by the controller 200, in other implementations, the method 400 may be performed by other devices (e.g., a controller included in the server 112).

Figure 5A:
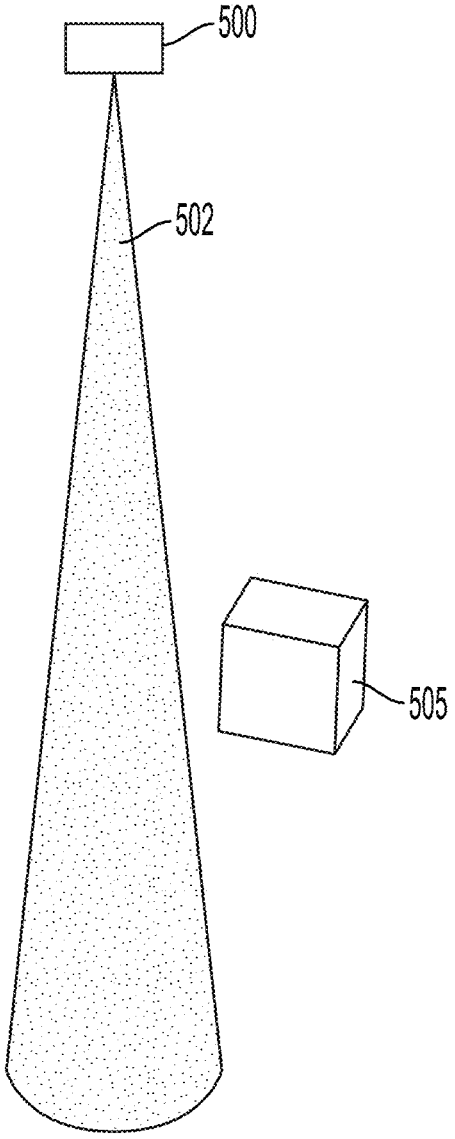
FIG. 5A illustrates a light beam from a lighting fixture and an object of interest, according to one example.
Figure 5B:
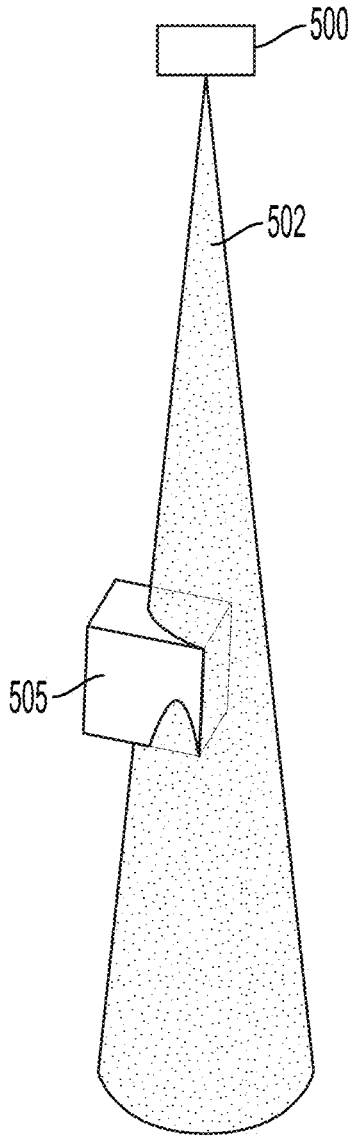
FIG. 5B illustrates the light beam from a lighting fixture colliding with the object of interest from FIG. 4A.

At block 405, the controller 200 determines a path of a light beam. As one example, FIGS. 5A and 5B provide a virtual lighting fixture 500 and a virtual light beam 502. The virtual light beam 502 represents a light beam projected by the virtual lighting fixture 500 when the virtual lighting fixture 502 is "ON". In some implementations, the controller 200 determines the path of the virtual light beam 502 using a ray tracing algorithm.

At block 410, the controller 200 receives a first user input indicating an object of interest. For example, FIGS. 5A and 5B also provide an object of interest 505. The object of interest 505 may be, for example, a virtual set piece representative of a set piece located within the venue 300, a virtual prop representative of a prop located within the venue 300, a virtual actor representative of an actor (or actor staging) located within the venue 300, or the like. In some instances, the object of interest is a physical object in the venue 300 that is tracked by the controller 200, or is a combination of the virtual representation and the physical object (e.g., an object that exists within the virtual environment and moves in an algorithmic manner but is located within the virtual environment based on the position of a physical object within the venue 300). FIG. 5A illustrates the object of interest 505 located outside the path of the virtual light beam 502. FIG. 5B illustrates the object of interest 505 located within the path of the virtual light beam 502.

At block 415, the controller 200 receives a second user input assigning a characteristic to the object of interest. In some instances, the characteristic indicates how light should interact with or how light should be projected onto the object of interest (e.g., indicates a particular function to be performed by a lighting fixture). As one example described with respect to FIG. 5B, the characteristic indicates whether light should be projected onto the object of interest 505 (e.g., whether the virtual lighting fixture 500 should be "ON" to project light). As another example, the characteristic indicates a color of light to project onto the object of interest 505 using the virtual lighting fixture 500. As yet another example, the characteristic indicates a pattern of the light (e.g., a mask, a filter) to project onto the object of interest 505 using the virtual lighting fixture 500. In some instances, multiple characteristics may be assigned to the object of interest 505 (e.g., a color and a pattern). In some implementations, the characteristic is metadata associated with the object of interest 505 and stored within the memory 210.

At block 420, the controller 200 determines whether the path of the light beam collides with the object of interest. For example, FIG. 5A provides an example where the virtual light beam 502 does not collide with the object of interest 505. FIG. 5B provides an example where the virtual light beam 502 does collide with the object of interest 505. The controller 200 may determine whether a collision is present using a ray tracing algorithm or another similar algorithm.

When a collision between the path of the light beam and the object of interest is not present (e.g., as shown in FIG. 5A), the controller 200 proceeds to block 425. At block 425, the controller 200 controls the lighting fixture according to a default setting. For example, within the virtual environment, the virtual lighting fixture 500 may have a default setting to project a white light beam 502, to be in an "OFF" state where no light is projected, or the like. When a collision between the path of the light beam and the object of interest is present (e.g., as shown in FIG. 5B, the controller 200 proceeds to block 430. At block 430, the controller 200 controls the lighting fixture according to the characteristic of the object of interest. As one example, within the virtual environment, the virtual lighting fixture 500 projects a blue light beam 502 onto the object of interest 505 when the characteristic of the object of interest 505 indicates that a blue light should be projected onto the object of interest 505.

In addition to controlling the virtual lighting fixture 500, in some implementations, the controller 200 also controls the physical lighting fixture 102 at blocks 425 and 430. Accordingly, the physical lighting fixture 102 is controlled according to the characteristics assigned to objects of interests within the virtual environment and the collisions detected within the virtual environment. In some instances, movement of the object of interest 505 within the virtual environment is aligned in real-time with a physical object of interest within the venue 300. Accordingly, a theatrical production within the virtual environment aligns in real time with a physical production within the venue 300.

Figure 6A:
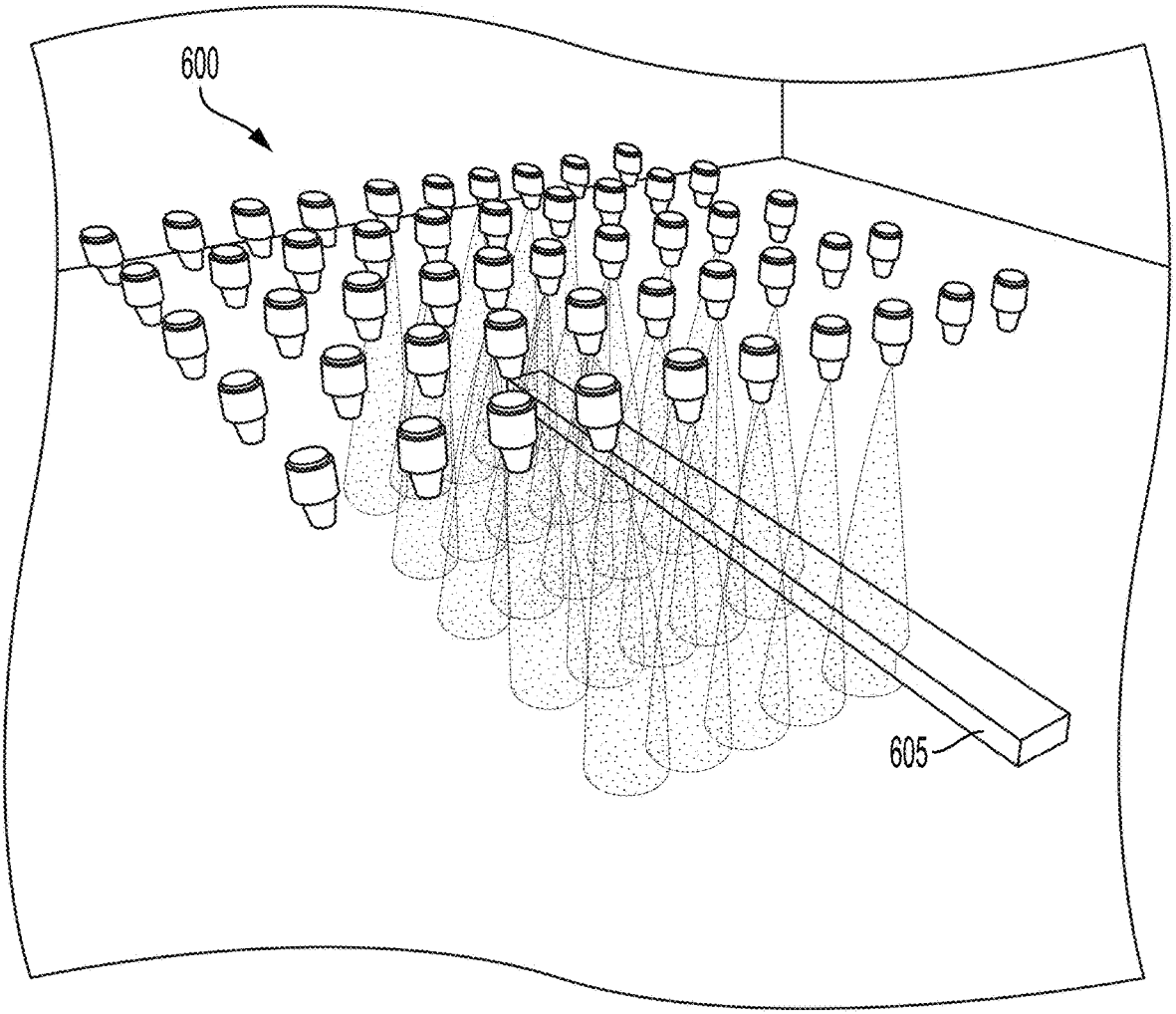
FIG. 6A illustrates a perspective view of a plurality of light beams illuminating an object of interest, according to one example.
Figure 6B:
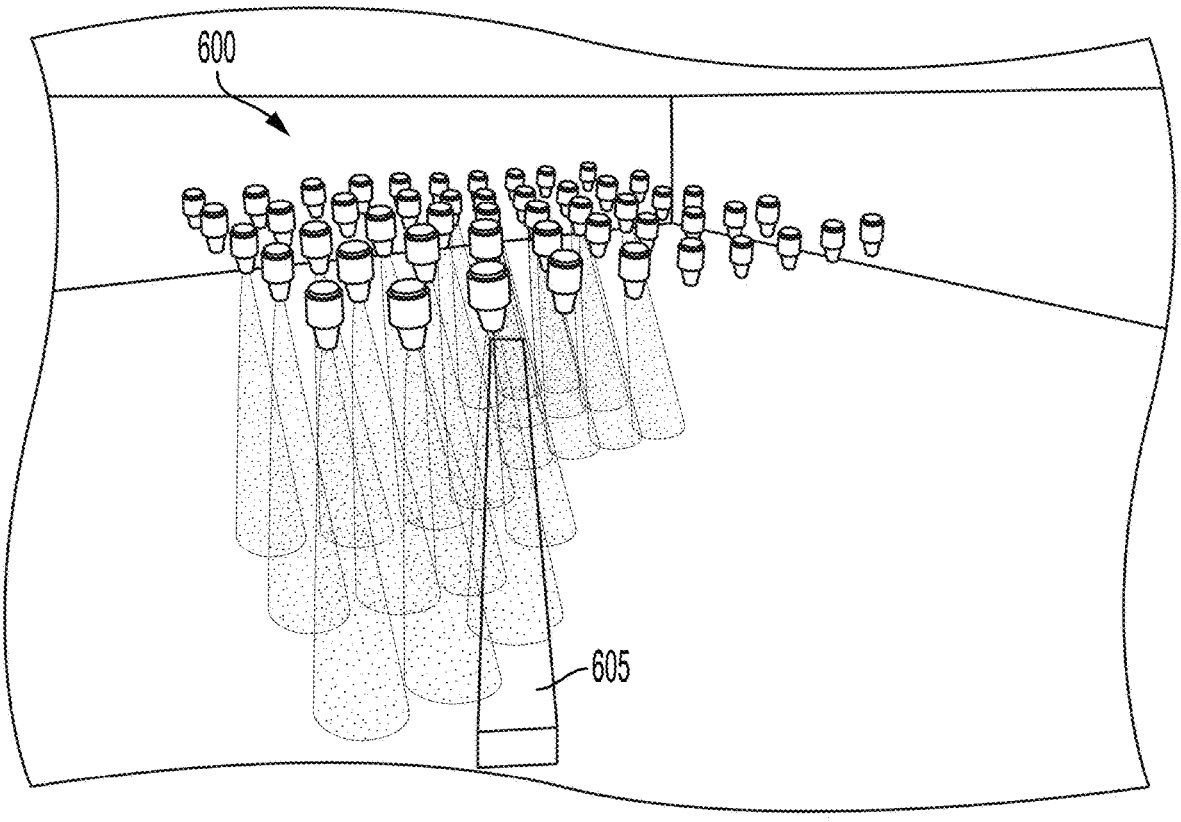
FIG. 6B illustrates another perspective view of a plurality of light beams illuminating an object of interest, according to another example.

While FIGS. 5A and 5B provide a single virtual lighting fixture 500, in some instances, several lighting fixtures are present. For example, FIGS. 6A and 6B provide a plurality of virtual lighting fixtures 600 and an object of interest 605 configured as a beam. In some implementations, the plurality of virtual lighting fixtures 600 correspond to a plurality of lighting fixtures 102 in the venue 300. In the example of FIG. 6A and 6B, the object of interest 605 is assigned a characteristic of being illuminated. Accordingly, any virtual lighting fixture 600 that is above the object of interest 605 turns "ON" to project light onto the object of interest 605 if the path of the respective light beam collides with the object of interest. Any virtual lighting fixture 600 that is not above the object of interest 605 defaults to "OFF" and does not project light. In FIG. 6A, the object of interest 605 is at a first position such that a first set of the plurality of virtual lighting fixtures 600 are "ON" to project light. In FIG. 6B, the object of interest 605 is at a second position such that a second set of the plurality of virtual lighting fixtures 600 are "ON" to project light. In some implementations, as the object of interest 605 spins from the first position to the second position, the controller 200 constantly updates the plurality of virtual lighting fixtures 600 such that the object of interest 605 stays illuminated.

Figure 7:
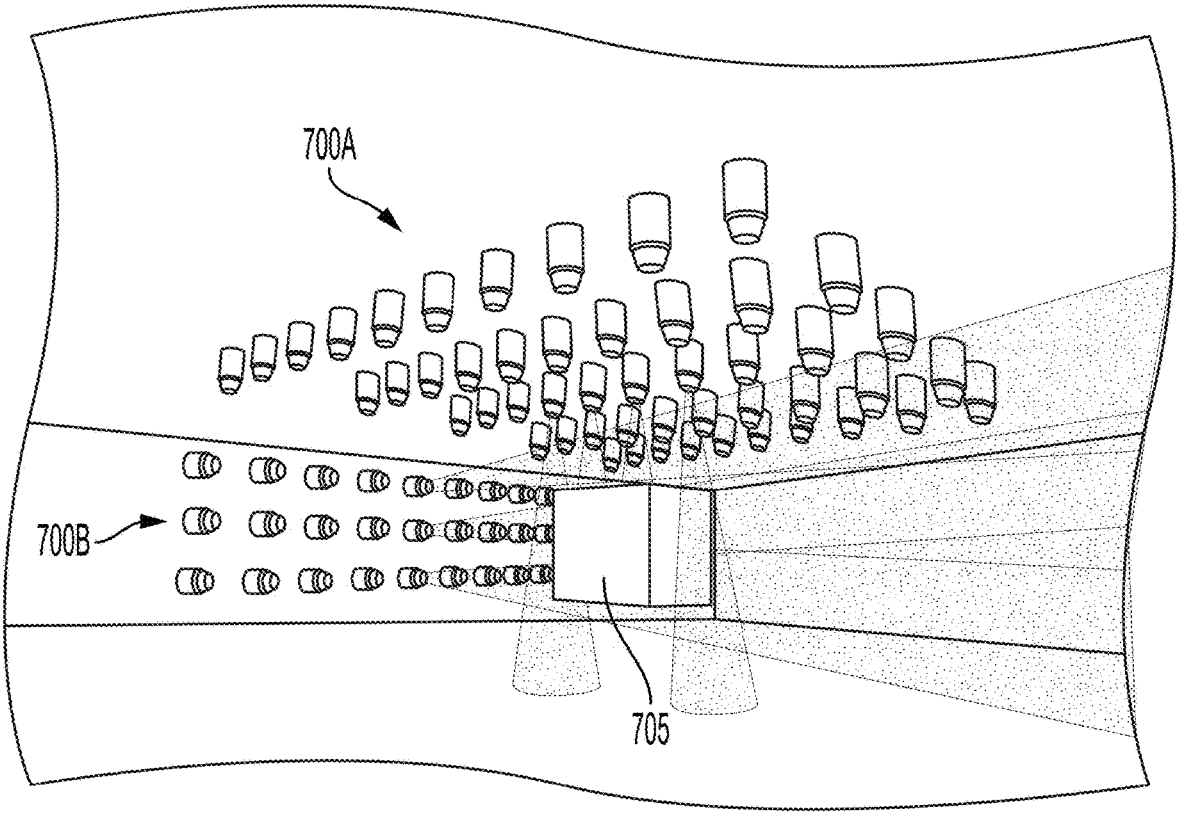
FIG. 7 illustrates another perspective view of a plurality of light beams illuminating an object of interest, according to another example.

FIG. 7 provides another example of a plurality virtual lighting fixtures 700 projecting light onto an object of interest 705. The plurality of virtual lighting fixtures 700 include a vertical plurality of virtual lighting fixtures 700A projecting light downwards onto (e.g., perpendicular to) a stage or floor, and a horizontal plurality of virtual lighting fixtures 700B projecting light parallel to the stage or floor. In some implementations, the plurality of virtual lighting fixtures 700 correspond to a plurality of lighting fixtures 102 in the venue 300. In the example of FIG. 7, the object of interest 705 is assigned a characteristic of being illuminated. Accordingly, any virtual lighting fixture in the plurality of virtual lighting fixtures 700 that have their respective path of light beam collide with the object of interest 705 are turned "ON" to project light onto the object of interest 705. The default setting of the plurality of virtual lighting fixtures 700 (e.g., when the path of the light beam does not collide with the object of interest 705) is to turn the respective virtual lighting fixture 700 to "OFF" such that light is not projected by the respective virtual lighting fixture 700.

Figure 8:
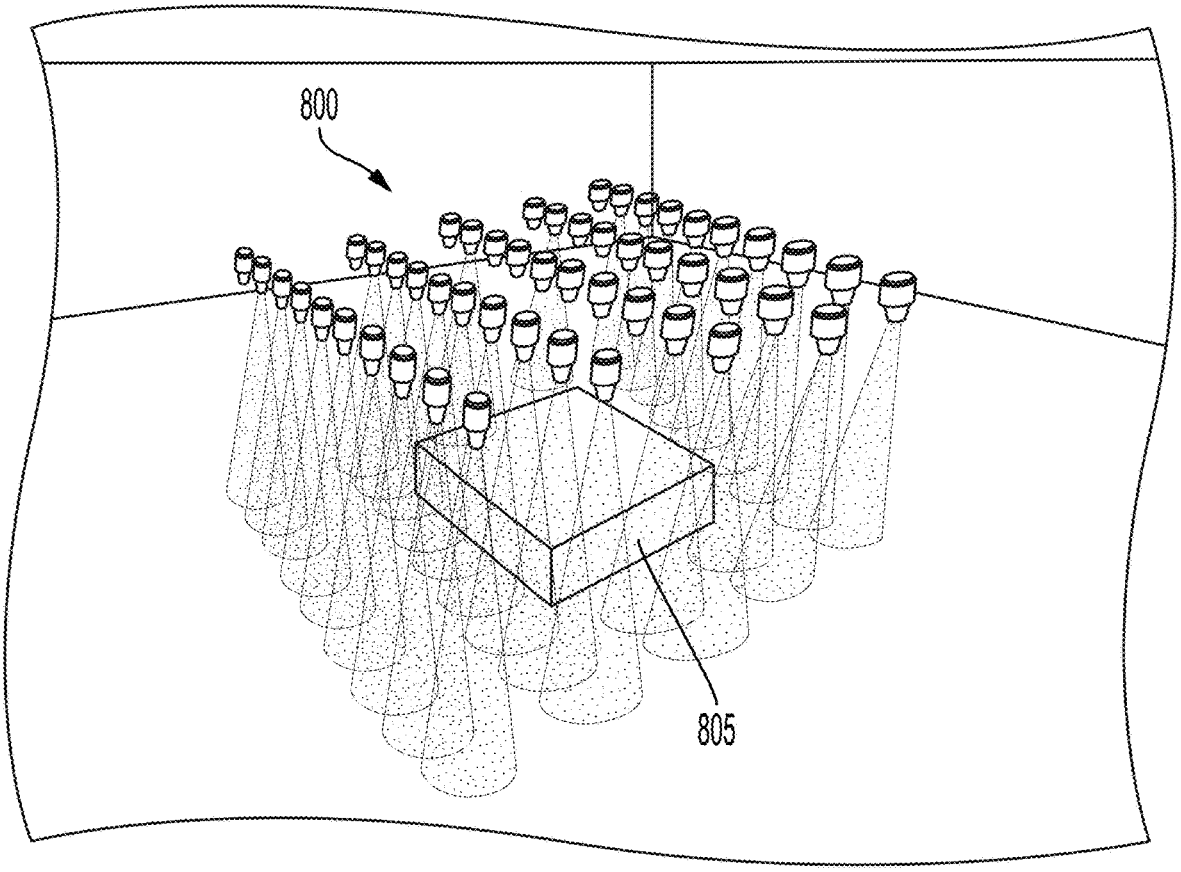
FIG. 8 illustrates a perspective view of a plurality of light beams not illuminating an object of interest, according to one example.

FIG. 8 provides an example of a plurality of virtual lighting fixtures 800 avoiding projecting light onto an object of interest 805. In some implementations, the plurality of virtual lighting fixtures 800 correspond to a plurality of lighting fixtures 102 in the venue 300. In the example of FIG. 8, the object of interest 805 is assigned a characteristic of being dark (e.g., not illuminated). Accordingly, any virtual lighting fixture 800 that is above the object of interest 805 turns "OFF" and does not project light if the path of the respective light beam collides with the object of interest. Any virtual lighting fixture 600 that is not above the object of interest 605 defaults to "ON" and projects light.

While examples provided in FIGS. 5A-8 illustrate only a single object of interest 505, 605, 705, 805, in some instances, a plurality of objects of interest are situated within the virtual environment. Accordingly, at block 405, the controller 200 may receive a selection of a single object of interest from the plurality of object of interests, or a set of objects of interests from the plurality of interest. At block 410, the controller 200 may receive inputs assigning characteristics to multiple objects of interest. When a light beam collides with a first object of interest, the respective lighting fixture is controlled to perform a first function. When a light beam collides with a second object of interest, the respective lighting fixture is controlled to perform a second function.

In some instances, rather than the controller 200 performing a single action in response to a collision, detection of a collision with an object of interest causes the controller 200 to perform a "macro", or a series of functions. Functions within the macro may be unrelated to the light fixture projecting the light beam that collides with an object of interest. As one example, when a first light fixture 102 projects a light beam that collides with an object of interest, the controller 200 performs a macro that turns a second light fixture 102 to "OFF." In another example, when a first light fixture 102 projects a light beam that collides with an object of interest, the controller 200 performs a macro that adjusts a color of a second light fixture 102 and adjusts a pattern projected by a third light fixture 102. In some implementations, the controller 200 also performs functions unrelated to the lighting fixtures 102 when a collision is detected, such as playing a sound effect via speakers, initiating a video playback, raising a hoist, or performing other actions related to the venue 300.

Figure 9:
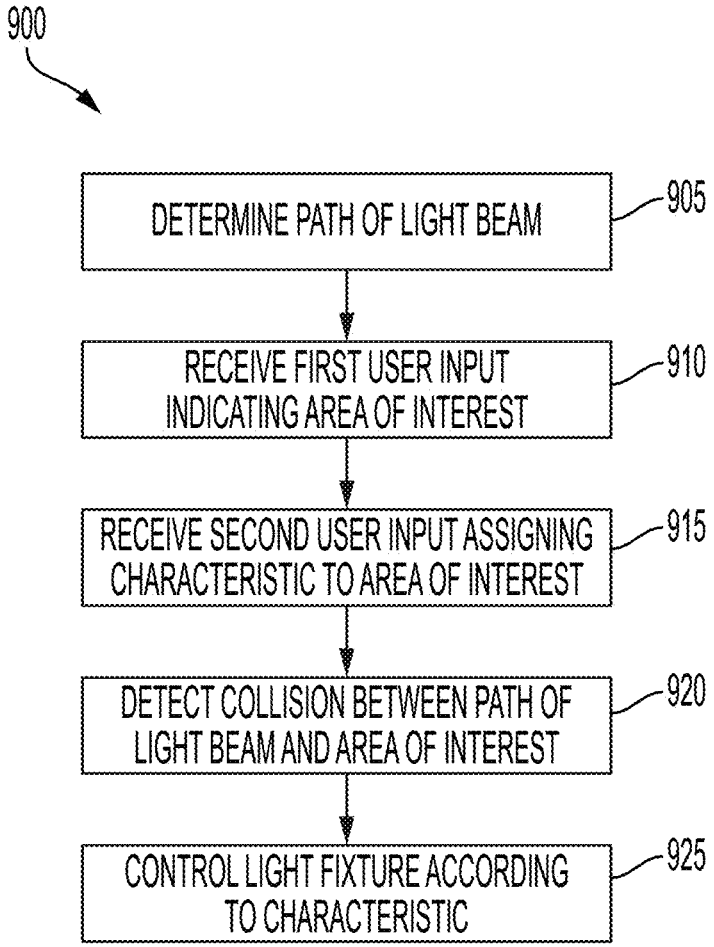
FIG. 9 illustrates another method performed by the controller of FIG. 2 or FIG. 2A, according to one example.

In addition to objects of interest, particular areas of the venue 300 may be indicated as areas of interest, such as particular sections of a stage, a backstage area, a seating area (e.g., where audience members are seated), and the like. FIG. 9 provides a method 900 for producing a lighting design for the venue 300 based on areas of interest. The steps of the method 900 are described in an iterative manner for descriptive purposes. Various steps described herein with respect to the method 900 are capable of being executed simultaneously, in parallel, or in an order that differs from the illustrated serial and iterative manner of execution. Additionally, while the method 900 is described as being performed by the controller 200, in other implementations, the method 900 may be performed by other devices (e.g., a controller included in the server 112).

Figure 10:
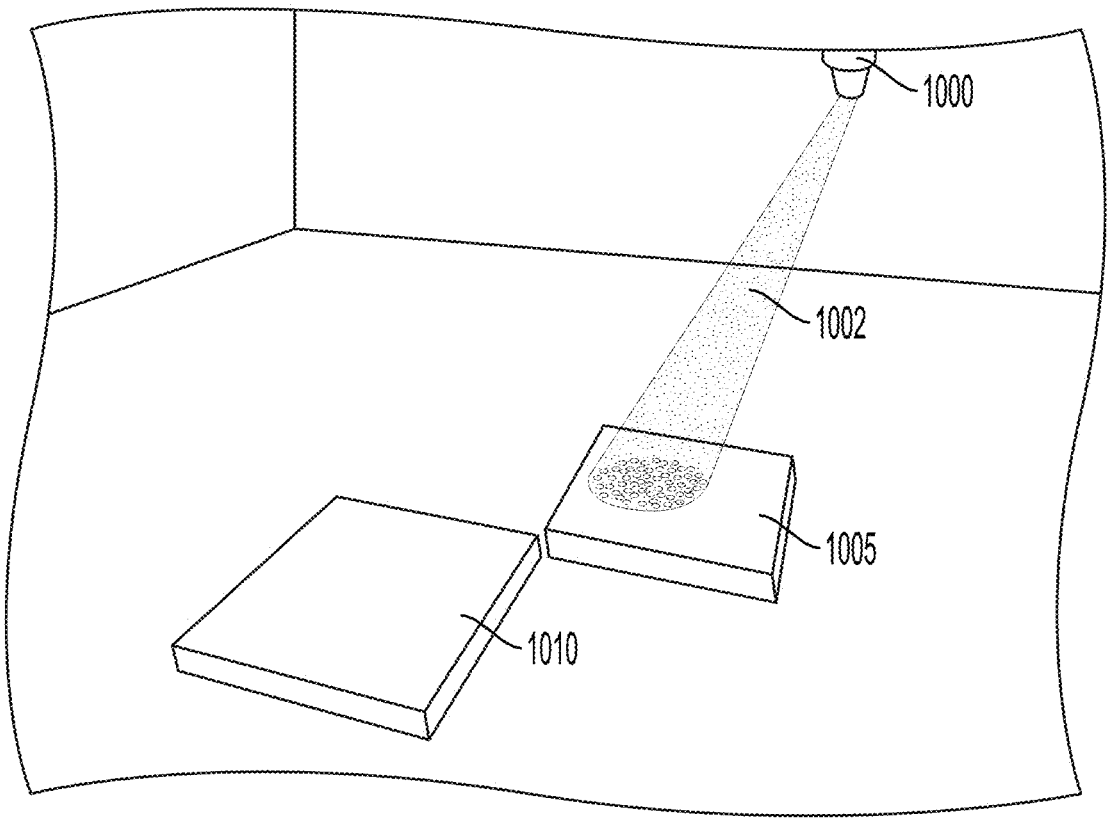
FIG. 10 illustrates a light beam and a plurality of areas of interest, according to one example.

At block 905, the controller 200 determines a path of a light beam. For example, FIG. 10 provides a virtual lighting fixture 1000 and a virtual light beam 1002. The virtual light beam 1002 represents a light beam projected by the virtual lighting fixture 1000 when the virtual lighting fixture 1000 is "ON".

At block 910, the controller 200 receives a first user input indicating an area of interest. As one example, FIG. 10 also provides a first area of interest 1005 and a second area of interest 1010. The first area of interest 1005 is a virtual representation of a first section of the venue 300 within the virtual environment, and the second area of interest 1010 is a virtual representation of a second section of the venue 300 within the virtual environment. A user selects the area of interest using an input mechanism of the user input device 104A-104D. For example, a user may use a computer mouse to click and drag to select the area of interest.

At block 915, the controller 200 receives a second user input assigning a characteristic to the area of interest. As one example, the characteristic indicates whether light should be projected onto the first area of interest 1005. As another example, the characteristic indicates a color of light to project onto the first area of interest 1005 using the virtual lighting fixture 1000. As yet another example, the characteristic indicates a pattern of the light (e.g., a mask, a filter) to project onto the first area of interest 1005 using the virtual lighting fixture 1000. In some instances, multiple characteristics may be assigned to the first area of interest 1005 (e.g., a color and a pattern). In some implementations, the characteristic is metadata associated with the first area of interest 1005, metadata associated with the second area of interest 1010, or a combination thereof. The metadata is stored within the memory 210.

At block 920, the controller 200 determines whether the path of the light beam collides with the area of interest. For example, in FIG. 10, the virtual light beam 1002 collides with the first area of interest 1005, and the virtual light beam 1002 does not collide with the second area of interest 1010.

Figure 11:
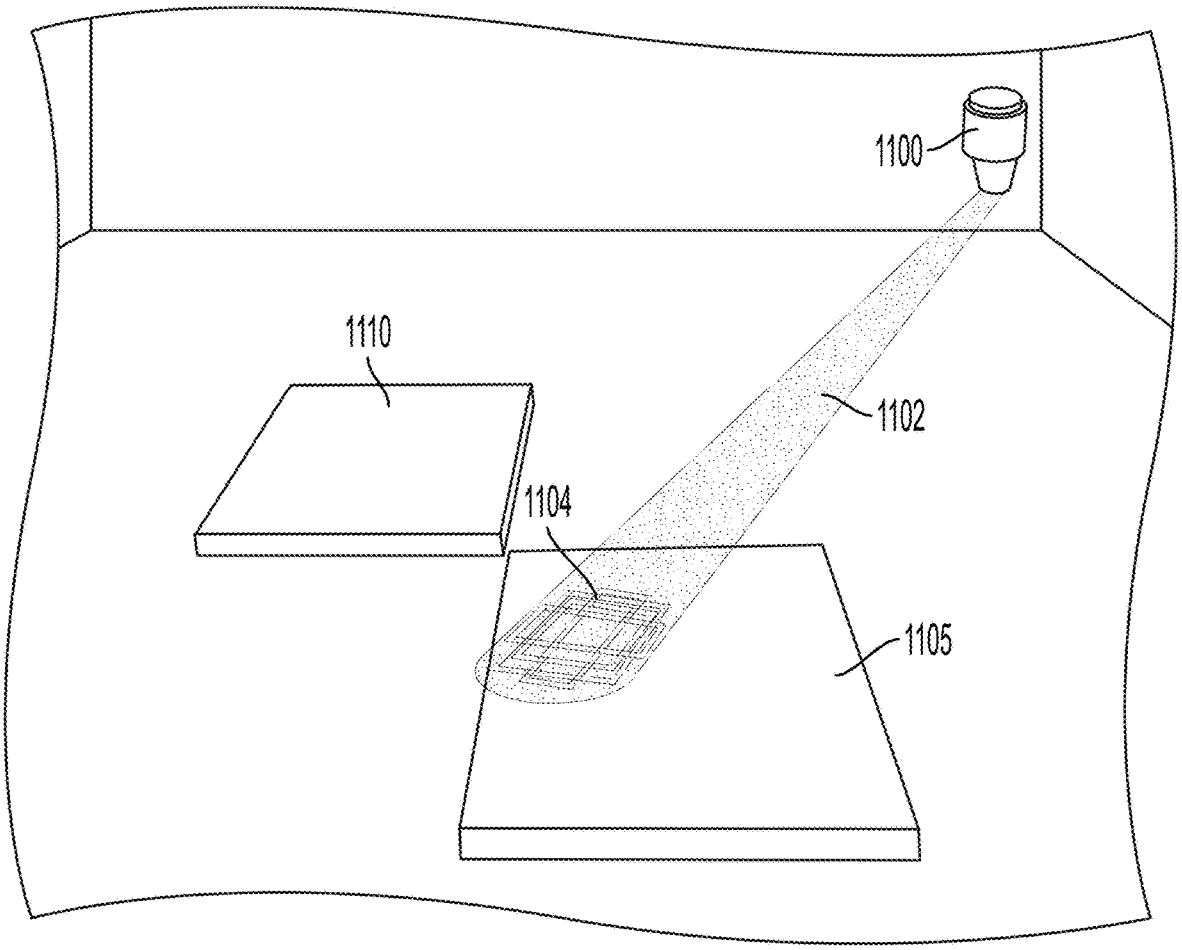
FIG. 11 illustrates a light beam and a plurality of areas of interest, according to another example.

At block 925, the controller 200 controls, when the path of the light beam collides with the area of interest, the lighting fixture according to the characteristic of the area of interest. For example, in FIG. 10, when the path of the virtual light beam 1002 collides with the first area of interest 1005, the virtual lighting fixture 1000 projects a virtual light beam 1002 of a first color. When the path of the virtual light beam 1002 collides with the second area of interest 1010, the virtual lighting fixture 1000 projects a virtual light beam 1002 of a second color. In another example, FIG. 11 provides a virtual lighting fixture 1100 projecting a virtual light beam 1102 onto a first area of interest 1105 or a second area of interest 1110. When the path of the virtual light beam 1102 collides with the first area of interest 1105, the virtual lighting fixture 1100 projects a virtual light beam 1102 having a first pattern 1104. When the path of the virtual light beam 1102 collides with the second area of interest 1110, the virtual lighting fixture 1100 projects a virtual light beam 1102 having a second pattern (not shown). In some implementations, the physical lighting fixtures 102 are controlled according to the characteristics assigned to areas of interests within the virtual environment and the collisions detected within the virtual environment.

Figure 12:
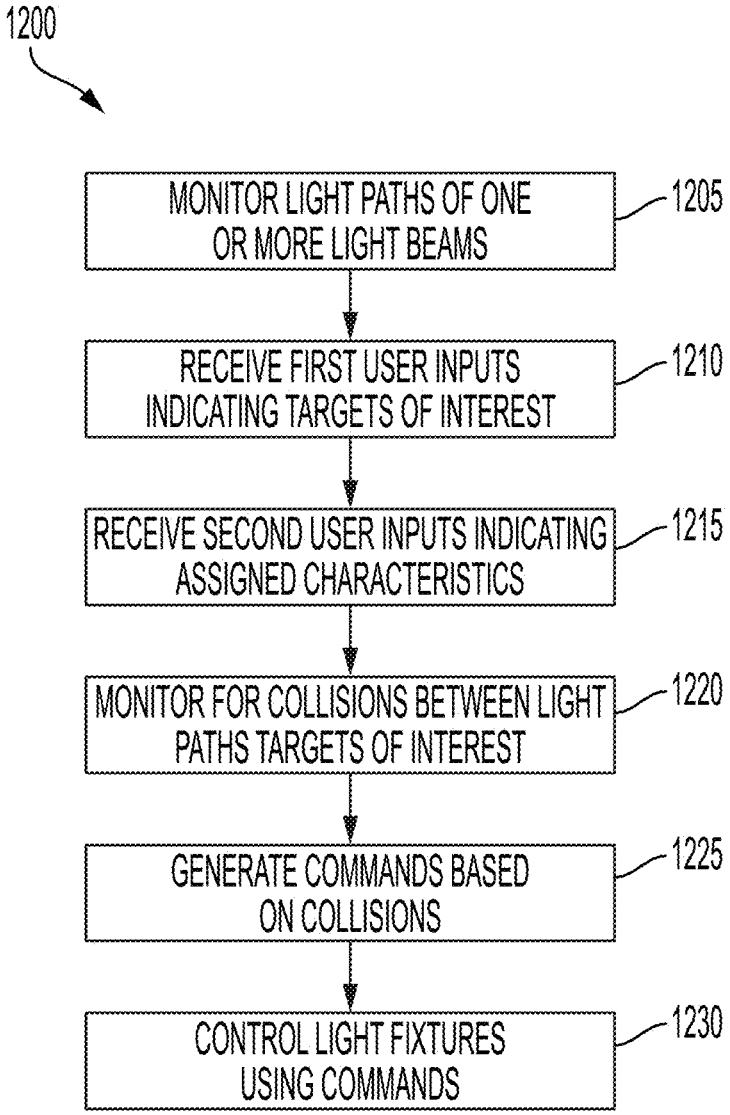
FIG. 12 illustrates another method performed by the controller of FIG. 2 or FIG. 2A, according to one example.

Commands for the lighting fixtures 102 may be generated "on the spot" (e.g., during a rehearsal or during a production) by performing methods 400 and 900 simultaneously with a live production in the venue 300. Additionally, commands for the lighting fixtures 102 may be pre-generated for a scene, multiple scenes, or an entire production within the virtual environment. FIG. 12 a method 1200 for producing a lighting design for the venue 300 over a period of time. The steps of the method 1200 are described in an iterative manner for descriptive purposes. Various steps described herein with respect to the method 1200 are capable of being executed simultaneously, in parallel, or in an order that differs from the illustrated serial and iterative manner of execution. Additionally, while the method 1200 is described as being performed by the controller 200, in other implementations, the method 1200 may be performed by other devices (e.g., a controller included in the server 112).

At block 1205, the controller 200 monitors the light paths of one or more light beams. For example, the controller 200 individually monitors the light paths of a plurality of virtual lighting fixtures within the virtual environment. At block 1210, the controller 200 receives first user inputs indicating targets of interest within the virtual environment (e.g., objects of interest and areas of interest). At block 1215, the controller 200 receives second user inputs assigning characteristics to the targets of interest.

At block 1220, the controller 200 monitors for collisions between the light paths of the one or more light beams and the targets of interest. The controller 200 monitors for the collisions over a period of time. The period of time may be set to, for example, a length of a scene in a production, a length of an act of a production, the length of a production, or the like. At block 1225, the controller 200 generates command frames based on detected collisions over the period of time. For example, when collisions are detected between the light paths of a light beam and a target of interest, the respective virtual lighting fixture is controlled according to the assigned characteristic of the object of interest. A command frame is generated that mimics or is otherwise reflective of the control of the respective virtual lighting fixture. The command frame may include, for example, one or more bits corresponding to an intensity of the light projected by the lighting fixture 102, one or more bits corresponding to a pan angle of the lighting fixture 102, one or more bits corresponding to a tilt angle of the lighting fixture 102, and the like. The command frame is then associated with a time at which the collision occurred. By associating the collisions and respective actions performed by the virtual lighting fixtures with a timeline, the events can be recreated.

At block 1230, the controller 200 controls the physical lighting fixtures 102 using the generated command frames over the period of time. Accordingly, the physical lighting fixtures 102 within the venue 300 are controlled to mimic the events of the virtual environment. The physical lighting fixtures 102 may be controlled simultaneously with the virtual environment, or may be controlled at a later time to recreate the events of the virtual environment.

Thus, embodiments described herein provide methods and systems for producing a lighting design for an event at a venue. Various features and advantages of some embodiments are set forth in the following claims.

What is claimed is:

1. A system for controlling lighting in a venue, the system comprising:

a lighting fixture configured to project a light beam;

an input device configured to receive a user input; and a controller including an electronic processor and a memory, the controller configured to:

determine, when the lighting fixture is deactivated, a path of the light beam, receive a first user input indicating a target of interest, receive a second user input assigning a characteristic to the target of interest, the characteristic indicating whether to project the light beam on the target of interest, detect a collision between the path of the light beam and the target of interest, determine, in response to the collision, whether to project light onto the target of interest based on the characteristic, and control, in response to the characteristic indicating to project light onto the target of interest, the lighting fixture to project the light beam on the target of interest.

2. The system of claim 1, wherein the controller is further configured to:

control, prior to detecting the collision, the lighting fixture to project the light beam, and control, in response to the characteristic indicating to not provide the light beam on the target of interest, the lighting fixture to deactivate the light beam.

3. The system of claim 1, wherein the target of interest is one selected from the group consisting of an object of interest and an area of interest.

4. The system of claim 1, wherein the characteristic further indicates a color of the light beam.

5. The system of claim 1, wherein the second characteristic further indicates a pattern to project on the target of interest.

6. The system of claim 1, further comprising a control board connected between the controller and the lighting fixture, wherein the controller controls the lighting fixture via the control board.

7. The system of claim 1, wherein the target of interest is a first target of interest, and wherein the controller is further configured to:

receive a third user input indicating a second target of interest, detect a second collision between the path of the light beam and the second target of interest, control, in response to the collision between the path of the light beam and the first target of interest, the lighting fixture according to a first function, and control, in response to the second collision between the path of the light beam and the second target of interest, the lighting fixture according to a second function.

8. A system for controlling lighting in a venue, the system comprising:

a lighting fixture configured to project a light beam;

an input device configured to receive a user input; and a controller including an electronic processor and a memory, the controller configured to:

determine a path of the light beam, receive a first user input indicating a target of interest, receive a second user input assigning a characteristic to the target of interest, monitor, over a first time period, for one or more collisions between the path of the light beam and the target of interest, generate a plurality of command frames based on the one or more collisions and based on the characteristic assigned to the target of interest, and control, with the plurality of command frames, the lighting fixture.

9. The system of claim 8, wherein the target of interest is one selected from the group consisting of an object of interest and an area of interest.

10. The system of claim 9, wherein the characteristic indicates at least one of a color of the light beam projected onto the target of interest and a pattern of the light beam projected onto the target of interest.

11. The system of claim 8, wherein the plurality of command frames includes commands for controlling the lighting fixture over the first time period.

12. The system of claim 8, wherein the characteristic is stored in the memory as metadata associated with the target of interest.

13. The system of claim 8, wherein the plurality of command frames is a first plurality of command frames, and wherein the controller is further configured to:

receive a third user input indicating a second target of interest, receive a fourth user input assigning a second characteristic to the second target of interest, monitor, over the first time period, for one or more second collisions between the path of the light beam and the target of interest, generate a plurality of second command frames based on the one or more second collisions and based on the second characteristic assigned to the target of interest, and control, with the plurality of second command frames, the lighting fixture.

14. The system of claim 8, wherein the characteristic indicates whether to project the light beam onto the target of interest.

15. A system for controlling lighting in a venue, the system comprising a lighting fixture configured to project a light beam;

an input device configured to receive a user input; and a controller including an electronic processor and a memory, the electronic processor configured to interact with a virtual environment stored in the memory, the electronic processor configured to:

determine a path of a virtual light beam projected by a virtual lighting fixture, receive a first user input indicating a target of interest within the virtual environment, receive a second user input assigning a characteristic to the target of interest, the characteristic indicating whether to project the virtual light beam on the target of interest, monitor, over a first time period, for one or more collisions between the path of the virtual light beam and the target of interest, generate a plurality of command frames based on the one or more collisions and based on the characteristic assigned to the target of interest, and control, with the plurality of command frames, the lighting fixture.

16. The system of claim 15, wherein the plurality of command frames includes commands for controlling the lighting fixture over the first time period.

17. The system of claim 15, wherein the characteristic is stored in the memory as metadata associated with the target of interest.

18. The system of claim 15, wherein the plurality of command frames is a first plurality of command frames, and wherein the electronic processor is further configured to:

receive a third user input indicating a second target of interest within the virtual environment, receive a fourth user input assigning a second characteristic to the second target of interest, monitor, over the first time period, for one or more second collisions between the path of the virtual light beam and the second target of interest, generate a plurality of second command frames based on the one or more second collisions and based on the second characteristic assigned to the second target of interest, and control, with the plurality of second command frames, the lighting fixture.

19. The system of claim 15, wherein the characteristic indicates whether to project the light beam onto the target of interest.

20. The system of claim 15, wherein the characteristic indicates at least one of a color of the light beam projected onto the target of interest and a pattern of the light beam projected onto the target of interest.

* * * * *